US005388889A

United States Patent [19]

Golynsky

[11] Patent Number: 5,388,889

[45] Date of Patent: Feb. 14, 1995

[54] TORQUE CONTROL MECHANISM FOR CHAIRS

[75] Inventor: Arkady Golynsky, Allentown, Pa.

[73] Assignee: Westinghouse Electric Corporation, Pittsburgh, Pa.

[21] Appl. No.: 125,270

[22] Filed: Sep. 23, 1993

[51] Int. Cl.[6] ..... A47C 3/026

[52] U.S. Cl. ..... 297/302; 297/304

[58] Field of Search ..... 297/300, 301, 302, 304

[56] References Cited

U.S. PATENT DOCUMENTS

| | | | |
|---|---|---|---|
| 2,859,799 | 11/1958 | Moore | 297/301 |
| 4,796,950 | 0/1989 | Mrotz et al. | 297/302 |
| 4,818,019 | 0/1989 | Mrotz | 248/596 |
| 4,858,993 | 0/1989 | Steinmann | 297/302 |
| 4,892,354 | 0/1990 | Estkowski et al. | 297/302 |
| 4,962,962 | 10/1990 | Machate et al. | 297/302 X |
| 4,966,411 | 0/1990 | Katagiri et al. | 297/301 |
| 5,029,940 | 0/1991 | Golynsky et al. | 297/301 |

FOREIGN PATENT DOCUMENTS

| | | | |
|---|---|---|---|
| 250995 | 1/1988 | European Pat. Off. | 297/301 |
| 2533428 | 3/1984 | France | 297/301 |

*Primary Examiner*—Peter R. Brown

[57] ABSTRACT

Disclosed is a knee tilt control mechanism for a pedestal type of chair. The control mechanism has a main torsion spring member secured to the control housing designed to resist pivotal movement of the chair seat about a pivot point on the housing. The chair control mechanism includes one or more lever arms attached at one end to the pivot point pins and attached at the other end to a link member. The link member has a pin adapted to slide within a retaining groove or slot in the chair control housing and is connected to the chair pivot point with a tension spring. The lever arm, link and tension spring supply a restoring force which when coupled to the torque force produced by the main spring, results in a restoring force that is nonlinear and is comfortable to the user for all positions of the chair.

9 Claims, 4 Drawing Sheets

TORQUE CONTROL MECHANISM FOR CHAIRS

This invention relates to a tilt control mechanism for a chair. It relates particularly to a knee tilt control mechanism for a pedestal type of office chair.

Chair controls are mechanical devices generally mounted beneath the seat of a chair to control the tilting of the chair when a user leans back in the chair. The control mechanism usually comprises a chair control housing adapted to be-mounted on a support column attached to the chair base and a chair seat support member or plate secured to the underside of the chair seat and pivotally mounted to the chair control housing. A spring or other energy storing device attached to the chair control housing controls the rate at which the user can tilt the chair rearwardly and returns the chair to its upright at-rest position when the user stops leaning backward.

Many chair controls have been pivoted about a point close to the center line of the chair control housing, which usually also coincides with the center of gravity of the user seated in the chair. As a result, the tilting of the chair backwards requires very little force, but raises the front of the chair seat, creating pressure on the back of the thighs and disturbing the blood circulation of the user. These chair controls require the user to exert considerable force through an extension of the leg and foot to maintain a tilted position for this type of chair. The result is not relaxing to the user.

Recently there have been developed knee tilt chair controls. Knee tilt chair controls function to pivot the chair seat support member or plate near the front of chair and as near to the natural knee joint of the user as possible so that the front of the seat rises very little or not at all during the rearward tilting of the chair. With a larger portion of the users weight positioned behind the chair control pivot point, little or no effort is required to maintain the chair in a reclined position and the feet of the user can remain flat on the floor with little effort.

The knee tilt control chairs, as compared to the traditional tilting chairs, require a much greater force to support the user on the forward extended moment arm and to return the reclined user to an upright position. Such force has been usually provided by torsion or compression springs that continually urge the seat portion of the chair upwardly into its normal horizontal position when unoccupied by a user. These springs generally create a restoring force that increases linearly as the tilt angle increases and requires the user to push harder with his or her legs and feet in order to make the chair fully recline. This linearly increasing restoring force has presented difficulties in making a knee tilt control chair that is comfortable to the user.

In an attempt to improve the comfort of knee tilt chairs to the user, some chair makers have used springs that have a low initial torque and a low spring rate. It has been observed that if a low initial torque and a low spring rate are used, just the weight of the user causes the seat to suddenly tilt backwardly through a substantial angle, such as about 10 degrees giving the user the feeling that the chair is falling backwards. This is obviously not satisfactory for an office chair that normally should not tilt more than 3 to 5 degrees when occupied, for maximum comfort when being used at a desk or table.

One attempt to counteract the excessive initial tilt caused by using springs of low initial torque and a low spring rate involved using a mechanical latch or locking device operated by the user to maintain the chair in an upright position when being used at a desk or table.

Another attempt to overcome this problem provided for an increase in the spring rate or the initial restoring force of the spring that maintains the unoccupied seat in its horizontal position. Increasing the spring rate or the initial restoring force, while tending to offset the excessive tilt from just the weight of the user, causes the linear relationship of the restoring force produced by the spring to be increased substantially throughout the entire tilt range of the chair, so that when the user attempts to tilt the chair backwardly through its full tilt range, a user may be unable to provide sufficient backward force to do so. As a result, the chair user finds such a chair uncomfortable due to the large restoring force that the user must overcome to just to tilt the chair.

U.S. Pat. No. 4,796,950 issued in 1989 to W. C. Mrotz et al. discloses a knee tilt chair control design which discloses another attempt to solve this problem. In this prior patent, a first restoring torque force for the chair is provided by a sleeve-like torsilastic spring member of an elastomeric material wrapped about a horizontal pivot hub. This patent discloses the use of additional compression springs and cam levers for generating a second restoring torque force which when added to the first restoring torque force causes a torque dwell in the control mechanism that is claimed to aid in the tilting of the chair beyond an intermediate position.

U.S. Pat. No. 4,818,019 issued in 1989 to W. C. Mrotz discloses a knee tilt chair control design that is still another attempt to solve this problem. In this prior patent, the restoring torque force is produced by a plurality of stacked Belleville compression springs contained within a horizontal tube or hub. These springs bear against actuators which rotate with the bearing hubs. The actuators have radial followers that engage nonlinear cams which increase the main spring compression and the restoring force nonlinearly, in accordance with the cam profile.

SUMMARY OF THE INVENTION

It is an object of this invention to provide a knee tilt chair control for a pedestal type of office chair that provides sufficient force to maintain the chair seat at a desired position when occupied by a user at a desk or table while also permitting the chair to be tilted rearwardly throughout its full range of tilt without generating an excessive restoring torque that makes tilting of the chair difficult or uncomfortable to the user.

It is another object of this invention to provide a knee tilt chair control for a pedestal type of office chair that provides a substantially nonlinear restoring torque or force throughout the various angles of tilt of the chair.

It is another object of this invention to provide a knee tilt chair control for a pedestal type of office chair that does not require any locking or other action by the user to maintain the chair seat in a substantially horizontal position and allows a automatic and relatively. effortless reclining when desired.

It is still a further object of this invention to provide a knee tilt chair control for a pedestal type of office chair that is simple, compact and easily adapted to various designs of knee tilt chairs without distracting from the appearance of the chair.

It has been discovered that foregoing objects can be attained by a knee tilt chair control for a pedestal base chair comprising a chair control housing mounted on a chair base and a chair seat support member pivotally attached to the forward portion of the chair control housing by pivot means. A main torsion spring member is secured to the chair control housing and is adapted to resist the pivotal movement of the seat support member. The chair tilt control includes one or more lever arms each having one end thereof attached to the pivot means and the other end thereof pivotally attached to one end of a link member. The other end of the link member has a link pin adapted to slide within a link pin retaining groove formed in the chair control housing. A tension spring extends from the pivot means to the link pin. The restoring force supplied by the tension spring and the link member and link pin assembly, when coupled with the torque supplied by the main torsion spring member, produces a resultant torque force that is non-linear throughout the full tilt range of the chair and comfortable to the user.

DESCRIPTION OF THE PREFERRED EMBODIMENT

Figure 1:
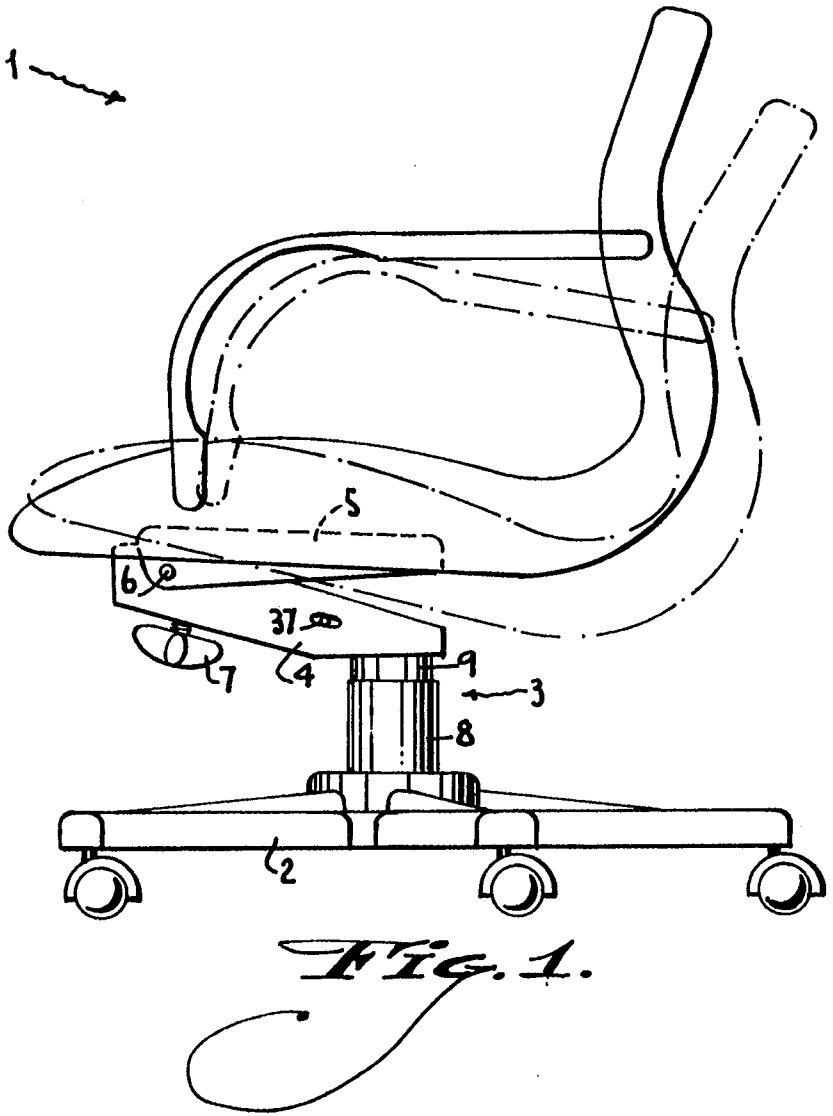
FIG. 1 is a side elevational view of a pedestal base office chair equipped with a preferred embodiment of a knee tilt chair control of this invention.

FIG. 1 illustrates a side elevational view of a typical knee tilt control office chair 1 having a base 2, an adjustable support 3, a chair control housing 4 and a tiltable chair seat support member 5 pivotally connected to the chair control housing 4 by a pivot pin or pins 6. The chair control housing 4 is provided with a tension adjustment knob 7 for adjusting the tension on a torsion spring that controls the rate at which the user can tilt the chair seat and the chair seat support member about the pivot pins 6 and which returns the chair 1 to an upright, at-rest position when the user stops leaning backwards.

Figure 2:
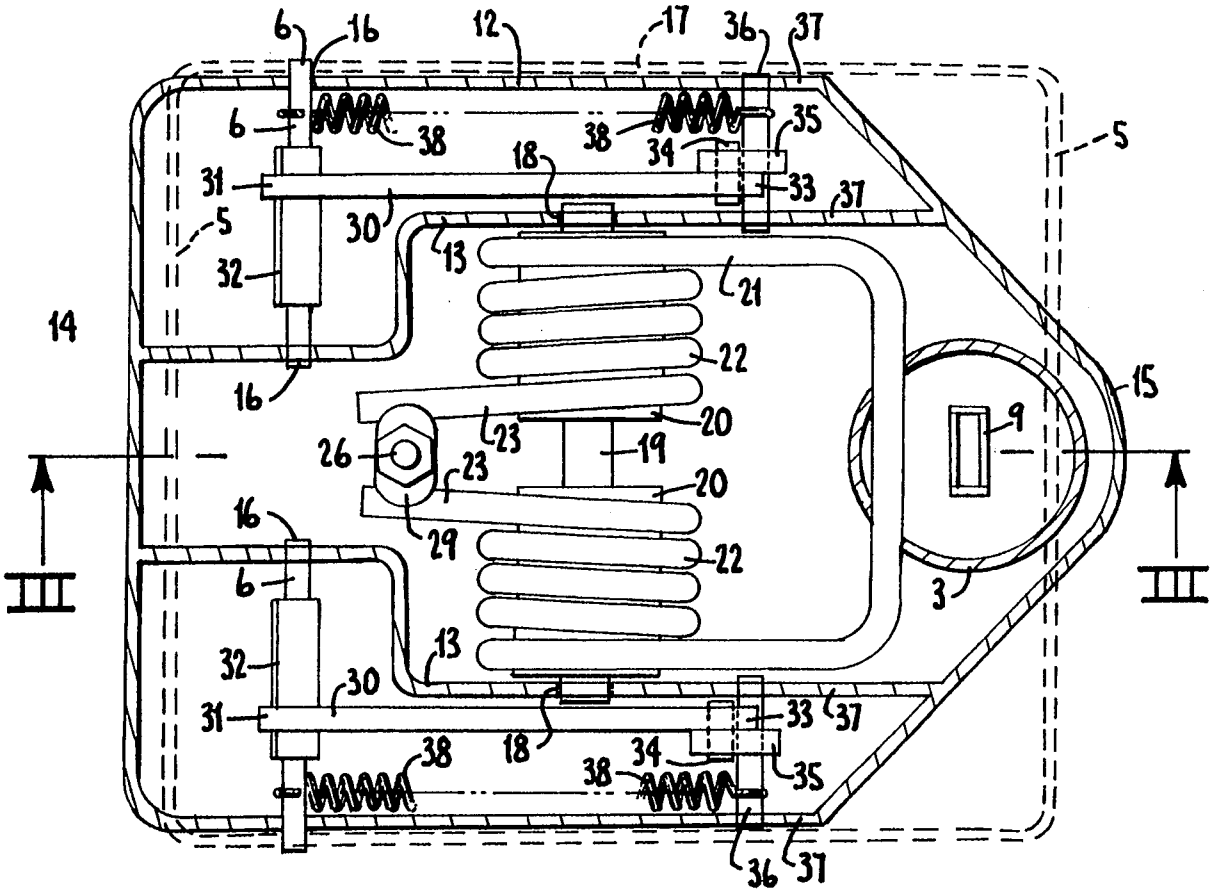
FIG. 2 is top view of the chair control housing illustrating a preferred embodiment of the knee tilt chair control of this invention with the chair seat support member shown in phantom.

FIG. 2 illustrates a top view of a preferred embodiment of the knee tilt control mechanism of this invention with the chair seat support member 5 shown in phantom. The knee tilt control mechanism is contained essentially in the chair control housing 4 attached to and supported by an adjustable support 3, which may be of a pneumatic or screw type of adjustable support which is capable of being moved up or down to position the chair seat at the proper height. FIG. 1 illustrates a pneumatic gas cylinder adjustable support 3, comprised of an outer cylinder 8 attached to the chair base 2 and an inner cylinder 9 which moves up and down to position the chair seat at the proper height. The movement up or down of the inner cylinder 9 is controlled by a handle (not shown).

Figure 3:
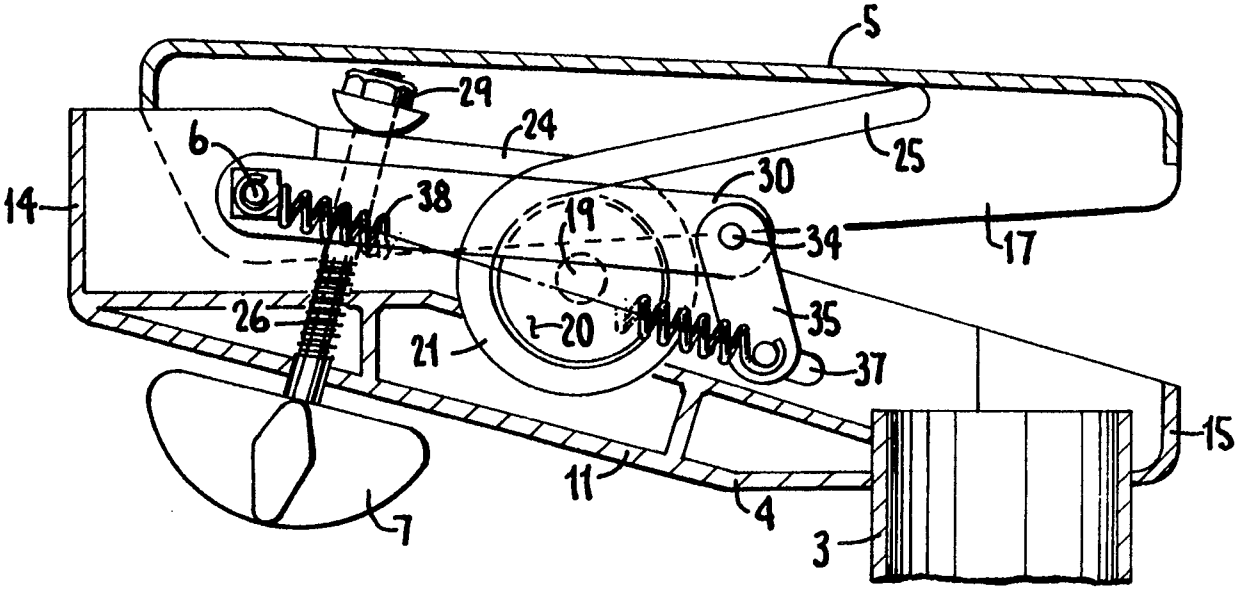
FIG. 3 is a side sectional view taken along section lines 3—3 in FIG. 2, illustrating a preferred embodiment of the knee tilt chair control of this invention when the chair is in an upright position with the chair seat substantially horizontal, shown as solid lines in FIG. 1.

As shown in FIGS. 2 and 3, the chair control housing 4 is made of metal, either die cast or stamped, and is comprised-essentially of a bottom portion 11, a pair of upstanding parallel outer side wall portions 12, a pair of upstanding parallel inner side wall portions 13, an upstanding front wall portion 14 and an angled or curved, upstanding back wall portion 15.

The upstanding parallel outer side wall portions 12 and the upstanding parallel inner side wall portions 13 of the chair control housing 4 are provided with aligned openings 16 adapted to receive and secure a pair of pivot pins 6 which also pass through a pair of downwardly facing parallel side portions 17 of the chair seat support member 5. The pivot pins 6 provide pivot points about which the chair seat support member 5 pivots relative to the chair control housing 4 and provides the tilting of the chair 1.

Figure 4:
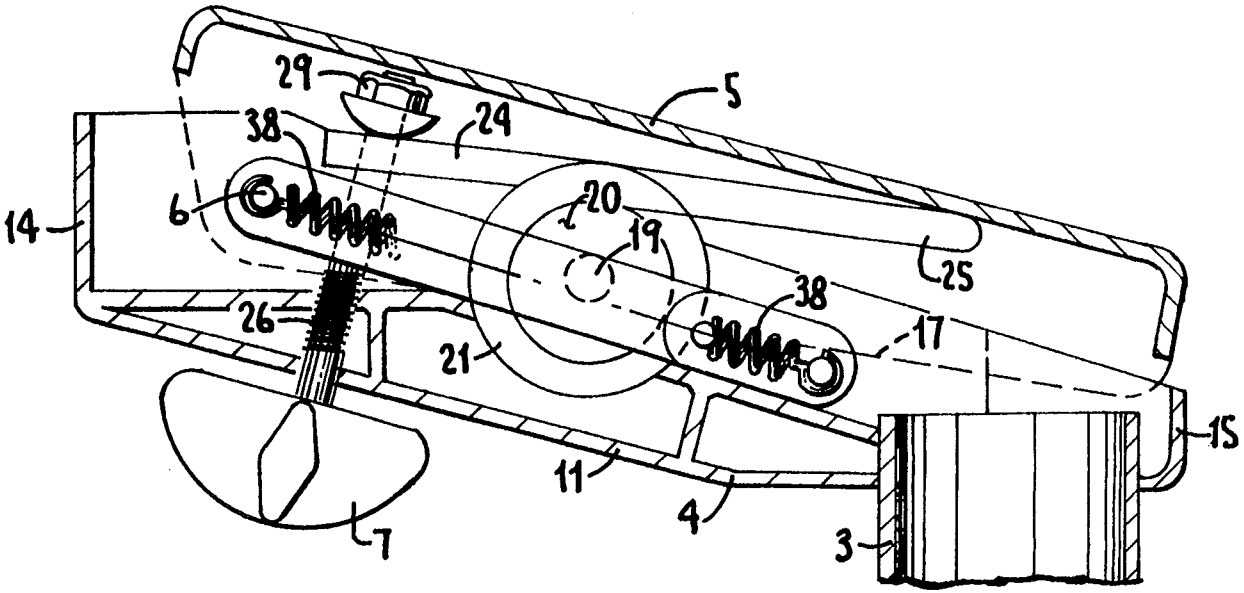
FIG. 4 is a side sectional view taken along section lines 3—3 in FIG. 2, illustrating a preferred embodiment of the knee tilt chair control of this invention when the chair is in a tilted position, shown as broken lines in FIG. 1.

As shown in FIG. 2, the inner side wall portions 13 are also provided with a pair of aligned openings 18 to receive and retain a spring support shaft 19 fitted with a pair of plastic or metal guides 20 and a double torsion spring 21 comprised of a pair of helical spring coils 22 which surround the spring support shaft 19 and sleeves 20, and a pair of forward extending legs or arms 23 and a rearwardly extending lever arm 25. As shown in FIGS. 2–4, the tension adjustment knob 7 used to control the tension of the spring 21 is attached to a tension screw 26 that passes through openings 27 in the front bottom portion 11 of the chair control housing 4 and up between the forward extending legs or arms 23 of the double torsion spring 21. A threaded nut 29 is fastened on the leading end of the tension screw 26 on top of the forward extending legs or arms 23 of the double torsion spring 21. Turning the tension adjustment knob 7 will increase or decrease the initial tension in the double torsion spring 21, as desired.

As shown in FIGS. 3 and 4, the rearwardly extending lever arm 25 of the double torsion spring 21 bears against the flat underside of the rear portion of the chair seat support member 5 and provides the torsional resistance to the tilting of the chair 1 by the user. In the preferred embodiment of the chair tilt control of this invention, there is provided a pair of lever arms 30, each having the front end 31 thereof attached securely to one of the pivot pins 6 or to a sleeve 32 secured to the pivot pin 6. In this embodiment the lever arms 30 are positioned between the outer sidewall portions 12 and the inner sidewall portions 13 of the chair control housing 5, as illustrated in FIGS. 2 and 3. The rear ends 33 of the lever arms 30 are pivotally connected with pins 34 to one end of each of a pair of short link members 35. The other ends of the short link members 35 are fitted with link pins 36, each adapted to slide within link pin 36 retaining grooves or slots 37 formed towards the rear of the inner sidewall portion 13 and the outer sidewall portion of the chair control housing 4. A pair of tension springs 38 extend between and are connected to the pivot pins 6 and to the link pins 36, as shown in FIGS. 2–4.

In the embodiment of this invention as described above, when the seat of the chair 1 is in its normal horizontal at-rest position, the restoring torque provided by the torsion spring 21 is at its maximum, thereby providing adequate support at the normal, at-rest, upright position. Tilting of the chair causes the lever arms 30 and short link members 35 to move from the "dog-leg" position shown in FIG. 3 into an straight line alignment with each other as illustrated in FIG. 4, during which movement the link pins 36 move rearwardly along the link pin retaining grooves or slots 37. This movement of the lever arms 30 and short link members 35 is resisted by the tension springs 38.

This arrangement allows the chair control mechanism to develop a nonlinear resisting torque throughout the full tilt range of the chair 1. It also provides adequate resistance to support the chair seat and back in the upright, at-rest position, such as when being used at a desk or table, but also allowing the chair to be easily tilted backwards without the need to overcome a large restoring torque. While the restoring torque generated by the main torsion spring 21 linearly increases as the chair is tilted rearwardly, the restoring assembly comprised of the lever arms 30, link members 35, link pins 36 and tension springs 38 initially will deliver a maximum torque in the upright, at-rest seat position, then slowly decrease to about the 6 degree tilt seat position and then decrease torque rapidly during the further tilting of the chair until it reaches close to zero torque when the chair is in the fully reclined position.

The resultant torque force produced both by the main torsion spring 21 and also by the restoring assembly comprised of the lever arms 30, link members 35, link pins 36 and tension springs 38 is nonlinear. It linerally increases to about the 6 degree seat tilt position, and then undergoes a dwell or very minimal change during the further tilting of the chair and results in a chair in which the restoring torque force is not excessive and is comfortable to the user.

While I have described the preferred embodiment of this invention as a chair control mechanism employing a double helical coil torsion spring as the main spring, this invention may easily be adapted for use with other well known types of chair main springs that develop torque restoring forces, such as torsilastic springs, compression springs, leaf springs, conical coil springs and even torsion bars.

This invention also contemplates that in some chair designs, it may be possible to use only a single lever arm, link member, link pin and tension spring for the torque restoring assembly instead of the pair of lever arms 30, pair of link members 35, pair of link pins 36 and pair of tension springs 38, described in the preferred embodiment, so long as the lever arm is secured to the pivot point or pin about which the chair support member pivots about the control housing and the assembly is able to be axially aligned with a slot or groove in the housing that accommodates the sliding link pin.

While I have described this invention by illustrating and describing the preferred embodiment of it, I have done this by way of example, and am not to be limited thereby as there are modifications and adaption that could be made within the teachings of this invention.

I claim:

1. A chair tilt control for a chair comprising a chair control housing mounted on a chair base, a chair seat support member pivotally attached to the forward portion of said chair control housing by pivot means, a main spring member secured to said chair control housing and adapted to resist the pivotal movement of said seat support member, a first lever arm having one end thereof attached to said pivot means and the other end thereof pivotally attached to one end of a first link member, the other end of said link member having a link pin adapted to slide within a link pin retaining groove formed in said chair control housing, and a first tension spring extending between said pivot means and said link pin.

2. The chair tilt control of claim 1 in which the main spring member is one or more torsion springs.

3. The chair tilt control of claim 1 in which the main spring member is a torsilastic spring.

4. The chair tilt control of claim 2 in which the main spring member bears against the underside of the chair seat support member.

5. The chair tilt control of claim 1 further comprising a second lever arm, a second link member and a second tension spring, wherein one end of said second lever arm is attached to said pivot means and the other end thereof is pivotally attached to one end of said second link member, the other end of said second link member having a second link pin adapted to slide within a second link pin retaining groove formed in said chair control housing, and said second tension spring extending between said pivot means and said second link pin.

6. The chair tilt control of claim 1 in which the link pin retaining groove is formed in a side wall of the chair control housing.

7. The chair tilt control of claim 1 in which the force produced by the tension spring substantially equals the force produced by said main spring member.

8. The chair tilt control of claim 1 in which the combined resultant force produced by the main spring member and by the tension spring during the tilting of the chair seat support member is nonlinear.

9. The chair tilt control of claim 1 in which the combined resultant force produced by the main spring member and by the tension spring during the tilting of the chair seat support member is substantially equal to zero when the chair seat support member is pivoted about 6 degrees from the horizontal.

* * * * *